United States Patent [19]

Hueber

[11] 4,324,491

[45] Apr. 13, 1982

[54] DUAL MODE GUIDANCE SYSTEM

[75] Inventor: Werner G. Hueber, China Lake, Calif.

[73] Assignee: The United States of America as represented by the Secretary of the Navy, Washington, D.C.

[21] Appl. No.: 334,173

[22] Filed: Feb. 12, 1973

[51] Int. Cl.[3] ..... G01B 11/26; F41G 7/00; G01J 1/20

[52] U.S. Cl. ..... 356/152; 244/3.16; 244/3.13; 250/203 CT; 358/125

[58] Field of Search ..... 356/142, 152; 244/3.16; 178/6.8; 250/203 CT; 358/125

[56] References Cited

U.S. PATENT DOCUMENTS

| | | | |
|---|---|---|---|
| 3,567,163 | 3/1971 | Kepp et al. | 244/3.14 |
| 3,696,248 | 10/1972 | Cunningham et al. | 356/152 |
| 3,709,607 | 1/1973 | McConnell et al. | 356/152 |
| 3,723,005 | 3/1973 | Smith et al. | 356/152 |

FOREIGN PATENT DOCUMENTS

| | | | |
|---|---|---|---|
| 1406533 | 9/1969 | Fed. Rep. of Germany | 244/3.16 |

*Primary Examiner*—S. C. Buczinski

*Attorney, Agent, or Firm*—Robert F. Beers; W. Thom Skeer; Robert W. Adams

[57] ABSTRACT

An active (laser) and passive guidance system having a common sensor (silicon-vidicon) for target acquisition, non-imaging seeker (four quadrant detector integrated with four single detectors, gyro optics, electronics), and aim-point correlator. In the passive mode, the pilot detects the target on the sensor's visual display; aligns the seeker with the target by aim-point correlation, and initiates seeker tracking. In the laser mode, the seeker acquires and tracks the target, the acquisition sensor scans the area, and its signals are correlated with the seeker four detector signals. The point of maximum correlation is indicated on the display of the acquisition seeker and shows the point of laser illumination and seeker tracking.

5 Claims, 8 Drawing Figures

DUAL MODE GUIDANCE SYSTEM

BACKGROUND OF THE INVENTION

In the field of radiation sensors and sensor systems, prior sensors either are integrating devices which are not capable of suppressing background radiation, or they have low quantum efficiency at the wavelength high-power pulsed lasers are available.

In order to overcome the deficiencies of the sensors, some prior sensor systems use two sensors. One is for sensing passive radiating targets, and the other, for laser illuminated targets. The disadvantage of those systems is that their optics must be common to both sensors in order to reduce boresight misalignment, and the optical paths must be separated with beam splitters, which reduces the optical transmission.

Prior dual-mode systems, systems which can be operated in both active and passive modes, use a single sensor to both search for, and acquire, the target or object of interest. Thereby, a great deal more sophistication and higher data rate is required than is necessary for tracking alone.

Other prior dual-mode systems in which the active system includes a laser, use the passive sensor to confirm lock-on in the active mode. The disadvantage in those systems is that laser tracking, with its bang-bang operation, causes the scene on the passive sensor to be smeared.

DESCRIPTION OF THE PREFERRED EMBODIMENT

Figure 1:
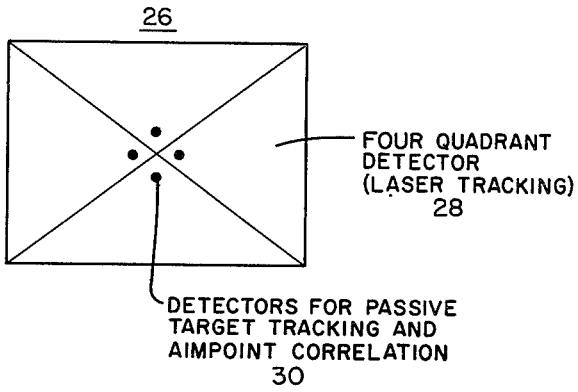
FIG. 1 is a plan diagram of the detector configuration which may be used in the present invention.
Figure 4:
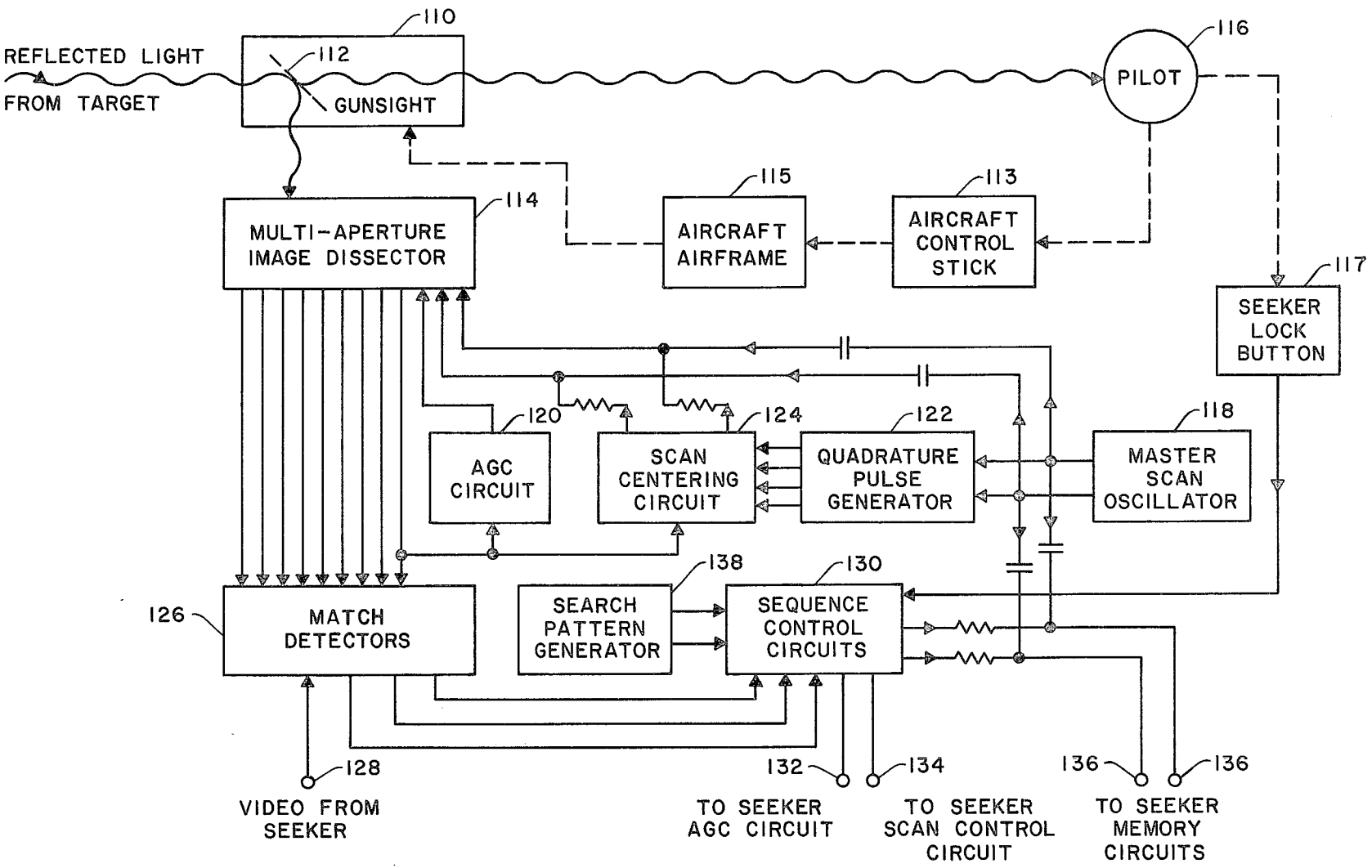
FIG. 4 is a schematic diagram of the preferred embodiment of the Aim-Point Correlator of U.S. Patent Application Ser. No. 614,527.
Figure 5:
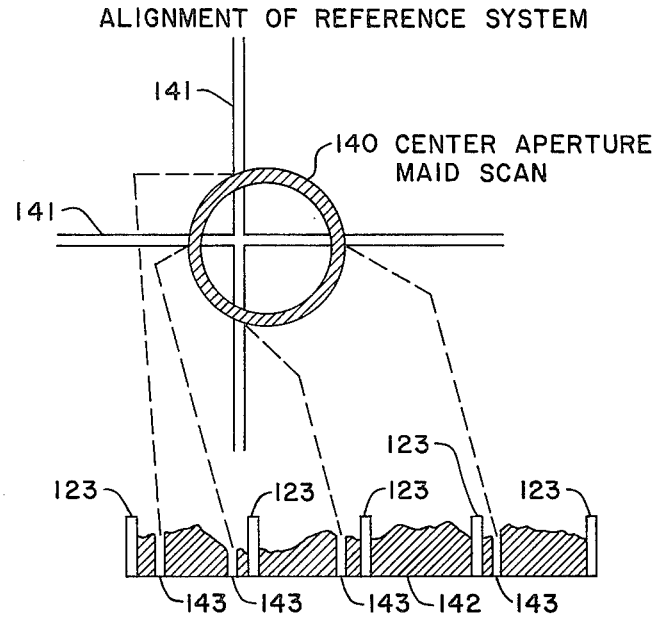
FIG. 5 is a graph showing the alignment of reference system of the embodiment of FIG. 4.
Figure 6:
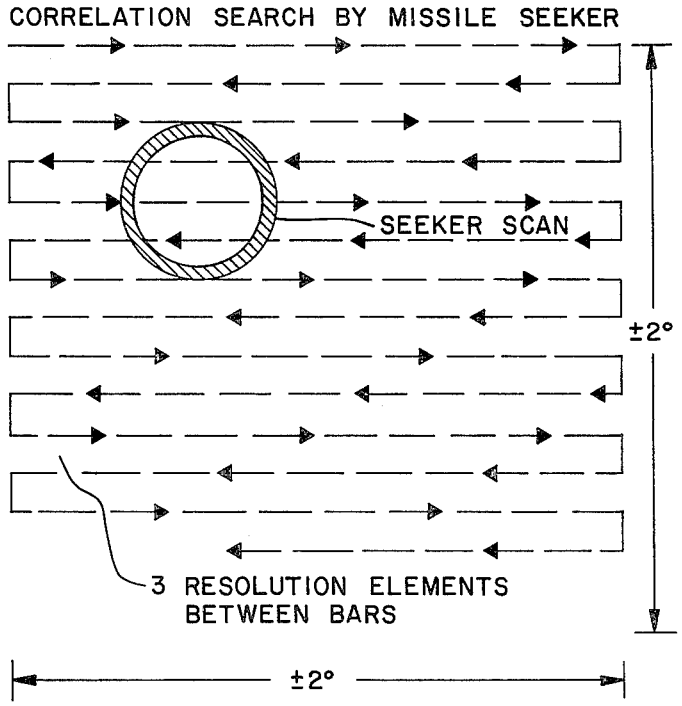
FIG. 6 is a graph showing a correlation search of a missile seeker per the preferred embodiment of FIG. 4.

The main components of the present invention are: An electro-optical sensor 10 such as a silicon-vidicon having a visual display 12 mounted in the aircraft 14; an aim-point correlator (APC) 16 that boresights, such as, the missile seeker 18 to the sensor 10 in the passive mode and indicates on the aircraft display 12 the location of the illuminated target being tracked by the seeker in the laser mode; and the dual-mode seeker including gyro-optics 20, silicon detectors shown in FIG. 1, and associated electronics 22 and 24. The APC may be of the type disclosed in U.S. Patent Application Ser. No. 614,527, entitled AIM POINT CORRELATOR, by Frederick C. Alpers, filed in the U.S. Patent Office Jan. 30 1967, which is disclosed as follows:

Referring now to the drawings there is shown in FIG. 4 a gunsight 110 which receives reflected light energy from a target. A partially silvered mirror 112 reflects a portion of the light received to a multi-aperture image dissector (MAID) 114 and also passes light to the pilot 116 where the image of the target can be viewed. By use of the aircraft control stick 113 the aircraft airframe 115 can be made to maneuver to bring gunsight 110 into line with the target. A master scan oscillator 118 provides the sine and cosine scanning voltages that will produce a circular scan in dissector 114. An automatic gain control circuit 120 has as its input the video from the center aperture of dissector 114 which provides an output voltage to control the gain of dissector 114 in accordance with the average scene brightness encountered in the course of the center circular scan. The sine and cosine outputs of master scan oscillator 118 are also coupled to quadrature pulse generator 22 which for each of scan quadrant generates a pulse that is fed to scan centering circuit 124. The output signals from multi-aperture image dissector 114 are fed to match detectors 126 where they are compared with the video signal received at terminal 128 from the seeker (not shown). The output signals from match detectors 126 are fed to sequence control circuits 130 which produce seeker control signals that are fed to the seeker AGC circuit, scan control circuit and memory circuits at output terminals 132, 134, and 136, respectively. Pulses for triggering sequence control circuits 130 are provided by a search pattern generator 138. Pilot 16 also provides an input to sequence control circuits 130 via seeker lock button 117.

In operation, the correlator accomplishes its function in four steps, which are illustrated in FIGS. 5 through 9. First, the multi-aperture dissector (FIG. 9) associated with the gunsight is caused to perform a circular scan 140 that is electronically aligned by means of scan centering circuit 124 to center on the point defined by the gunsight crosshairs 141, this scan produces a reference video signal 142 whose waveform depends on the scene being viewed at a given instant, except that signals 143 representing the crosshairs are superimposed at the points in the scan where the crosshairs come in front of the scene. Second, a synchronized circular scan of equal diameter (1.0 deg) is established in each seeker, and these scans are made by electronic deflection to search over their respective images through an angle of $\pm 2$ deg in both pitch and yaw (FIG. 6) about the nominal seeker axis position ($\pm 2$ deg is the maximum alignment deviation anticipated between each seeker axis and the point identified by the gunsight crosshairs). Third, the video signal resulting from the scan in each seeker is continuously checked against the reference video from the gunsight dissector by match detectors 126, and when a match throughout a scan cycle is detected (FIG. 7), the searching action for that particular seeker is stopped. Fourth, as the search actions are stopped, each seeker is switched into a condition in which automatic alignment tracking of the seeker axis with that of the center aperture of the gunsight dissector (FIG. 8) is maintained by the correlator. Each seeker is thus accurately and dynamically aligned so that the axis of its circular scan coincides with that of the scan of the gunsight dissector, which in turn is aligned with the axis of the gunsight. False matches which may occur momentarily due to coincidental similarities between different portions of the scene viewed will be quickly discarded and a search for true alignment reinstituted as the scene changes due to forward motion and maneuvering of the aircraft.

Figure 7:
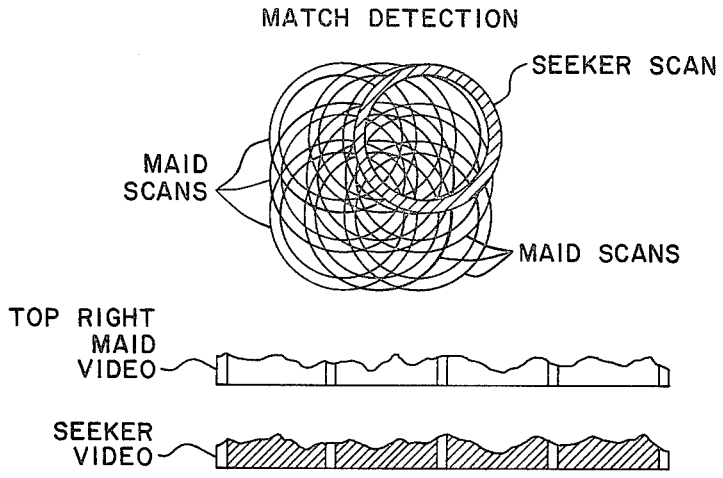
FIG. 7 is a graph showing the matched detection mode of the preferred embodiment of FIG. 4.
Figure 8:
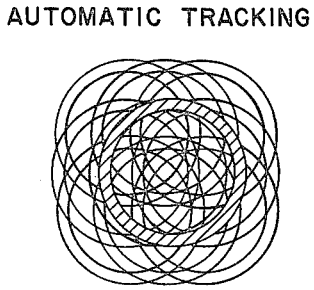
FIG. 8 is a graph showing the automatic tracking mode of the preferred embodiment of FIG. 4.
Figure 9:
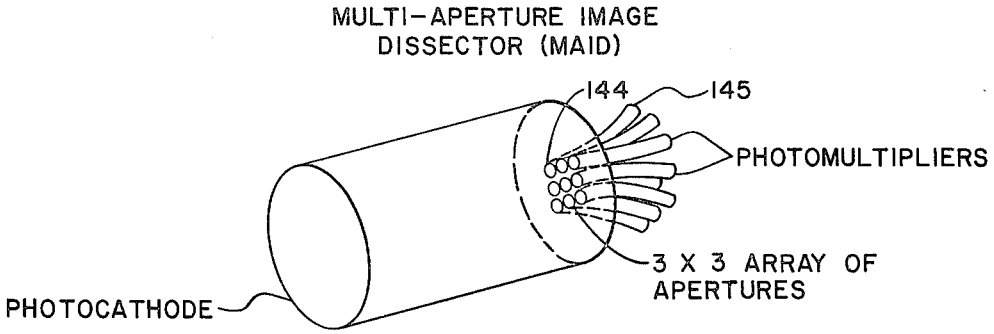
FIG. 9 shows one form of multi-aperature image disector used in the preferred embodiment of FIG. 4.

The type of automatic tracking action selected for the aim point correlator depends upon a simultaneous comparison technique that can be most easily implemented by the use of a multiple-aperture type of image dissector in the gunsight. The multi-aperture arrangement of the dissector in the gunsight is illustrated in FIG. 9 and the overlapping circular scans that are obtained with this arrangement are illustrated in FIGS. 7 and 8. The arrangement consists of nine apertures 144 in a 3×3 matrix. Channeltron type multiplier channels 145 of the Bendix Research Laboratories may be utilized at the output end of the dissector which will make it possible to space these apertures only one resolution element apart. Thus nine video outputs will be derived: one from a circular scan centered on the crosshair position as discussed above, one from a circular scan displaced one resolution element to the right, one from a scan displaced both one element upward and one element to the right, one from a scan displaced one element upward, etc. In the correlator tracking action, coincidence of the video from a given seeker with that from the center scan of the gunsight dissector will produce no correction of the seeker scan axis, while coincidence of the seeker video with that of the right circle of the gunsight dissector will result in a small leftward correction of the seeker scan axis, coincidence with the up circle will result in a downward correction, etc. The alignment will thus be retained without reverting to the search mode despite possible electronic drifts or flexure of structures between the cockpit and the missile seeker. The multiple aperture arrangement not only makes possible this simultaneous comparison type of tracking but also speeds up the search time since it makes it possible to check the seeker video signal simultaneously against nine different reference video signals.

The first of the four steps of the correlation process described above is implemented by quadrature pulse generator 122 and the scan centering circuit 124. The quadrature pulse generator 122 may be a set of four blocking oscillators arranged to trigger respectively at the four points in the scan cycle when either the sine or cosine voltage becomes zero, and generator 122 therefore generates a pulse 123 for each quadrant of advance of the circular scan. The scan centering circuit 124 may be a set of bistable multivibrator circuits (commonly called "flip flops"), each of which is turned on by a quadrature pulse 123 and turned off by a subsequent crosshair signal 143, followed by differential detector circuits that compare the on cycles of the opposing multivibrators to derive dc outputs that control the position of the dissector scanning and thereby center the scan. Thus the scan positioning is based on the relative timing of the quadrature pulses 123 and the black-level video signals 143 that result as the scan crosses each crosshair, and when the quadrature pulses and the corresponding black-level video signals are respectively in coincidence, the central scan circle is properly centered about the crosshair point. The scan centering circuit 124 should have a very long time constant so that integration will serve to eliminate any false centering effects caused by other black-level signals that appear momentarily due to dark line-like objects (e.g., asphalt roads) in the scene viewed by the gunsight dissector.

The second stop in the correlation process (that of causing seeker search) is performed by the search pattern generator 138. This unit includes a back-to-back sawtooth generator for horizontal search and a synchronized staircase waveform generator for vertical search that combine to produce the raster indicated in FIG. 6. The faster circuit scan is treated as an ac signal that is superimposed on the slower search pattern, which is treated as dc, and the two together are fed to the seekers in the missiles.

Both the third and fourth steps of the correlation process are performed basically by the match detectors 126, while the sequence control circuits 130, which can readily be implemented by a suitable connection of relays, regulate the switching of individual seekers from step to step as the correlation progresses. Each match detector may consist of a difference detector, an integrating circuit (to determine that the match is obtained over a complete cycle or more), and a bistable output; each detector will accept two analog video inputs and give a single digital-type "yes-no" output that indicates whether or not the two inputs match each other over a complete scan cycle. An entire "bank" of match detectors will be required—a separate one to compare the video from each seeker with each of the nine videos from the gunsight dissector. For each seeker being correlated, the outputs of the match detectors as a group will give (1) an indication of whether or not a match is present at that instant, and (2) an indication of the position of any existing match with respect to the desired match involving the center aperture of the matrix. The first output from match detectors 26 can be supplied as a voltage to initiate appropriate relay action in the sequence control circuits 130; the second can be supplied in the form of small dc yaw and/or pitch correction signals that can be delivered to the seeker via terminals 136 to center the scan as required. During the correlation search and tracking processes, the sequence control circuits 130 cause the AGC circuit within each seeker to switch to a functioning mode that directly parallels that of the correlator AGC circuit in order that the amplification of the respective dissectors will be equal and the resultant videos will be of comparable voltage levels; and these sequence circuits also cause the seeker's own scanning circuits to be temporarily deactivated and the scan/search signals from the correlator to be substituted.

When the pilot has a target sighted in his crosshairs and pushes the "Seeker Lock" button, 117, the sequence control circuits 130 cause the seeker in the selected missile to commence independent scanning through activation of the seeker's own scan circuit, and also cause the seeker to convert to an AGC mode that is optimized for seeker gray-level tracking, as described in copending application Ser. No. 434,740 filed Feb. 18, 1965 entitled "Gray-Level Angle-Gated Electro-Optical Seeker". In the lock-on process, the seeker memory circuits retain the aim point positional information supplied by the correlator at the instant of switchover; the seeker commences its circular scan about this point at essentially zero scan diameter, and gradually increases this diameter until changes in gray level occur which signify that the edges of the target have been reached, whereupon normal seeker tracking and scan size control functions take over. The gray-level memory in the seeker first "memorizes" the target gray level encountered when the scanning circle is at essentially zero diameter, and thereafter tracks the gray level in the manner described in the above-referenced copending application.

Figure 10:
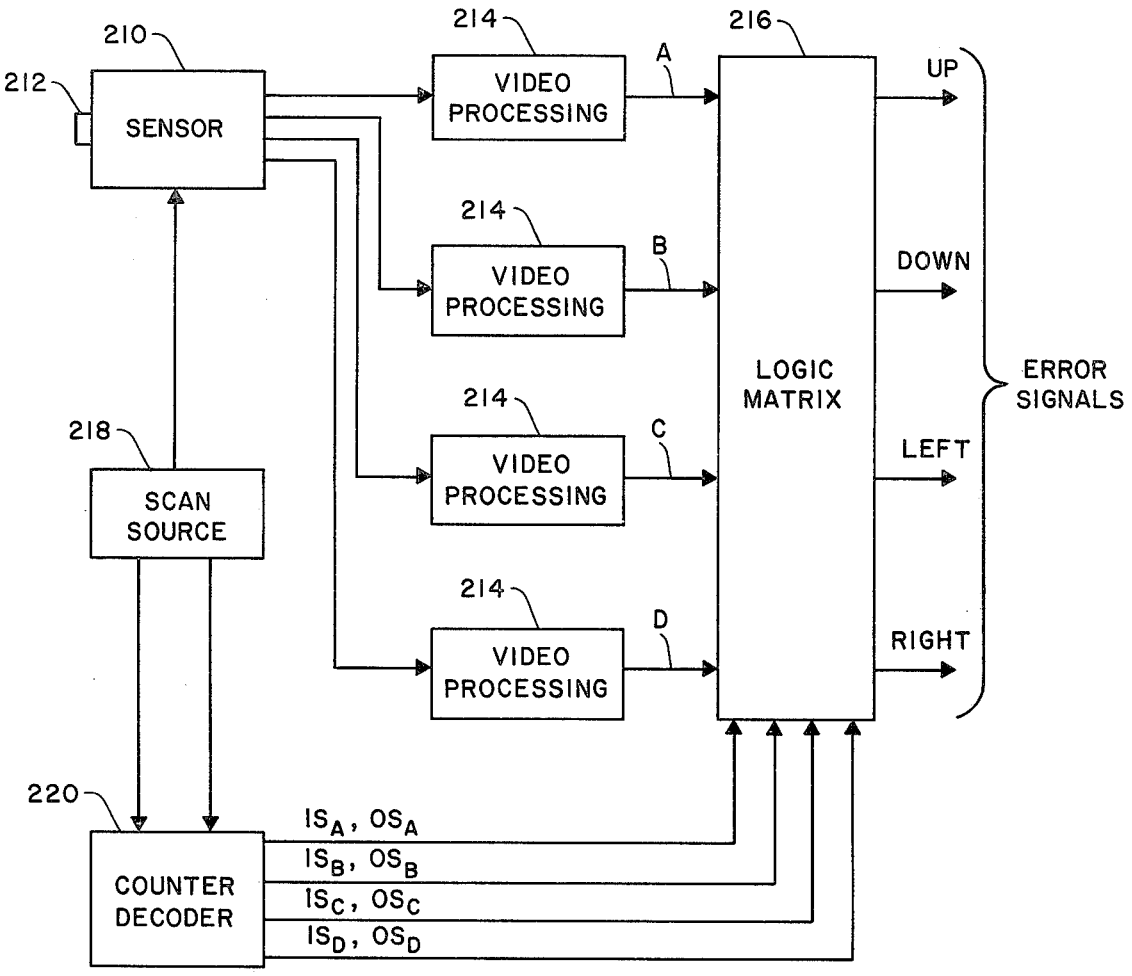
FIG. 10 is a block diagram of the preferred embodiment of the Bi-Adaptive Scan Digital Universal Sensor Target Tracker of U.S. Pat. No. 3,731,104.
Figure 13:
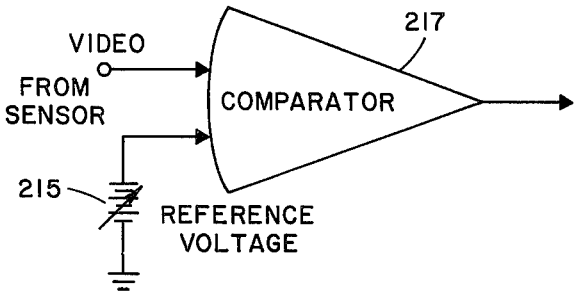
FIG. 13 is one form of video processing circuit of FIG. 10.

The electro-optical sensor may be of the type disclosed in U.S. Pat. No. 3,731,104, entitled BI-ADAPTIVE SCAN DIGITAL UNIVERSAL SENSOR TARGET TRACKER, by Barry S. Todd and Werner G. Hueber, filed in the U.S. Patent Office Jan. 4, 1971, which is disclosed as follows:

Referring now to FIG. 10 there is shown in the preferred embodiment in block diagram a sensor 210 which may consist of a number of detectors physically or by electronic means separated spatially with respect to the field of view 212. Sensor 210 may take the form of a multi-aperture image disector, a mechanical scan infrared system with multiple detectors, or four reflector/-receiver radar array using a single transmitter with conical scan. Sensor 210 may be constructed to be sensitive in any region of the electromagnetic spectrum. Each of the detector outputs from sensor 210 is connected to a video processing circuit 214. If a target is present in one of the sectors being scanned an output from video processing circuit 214 corresponding to the detector for that particular sector will appear as an output and is fed as a signal input to logic matrix 216. Video processing circuit 214 may be of the type shown in FIG. 13 where the output signal from sensor 210 is compared with a reference voltage 215 by means of comparator 217. Scan source 218 provides the scanning signal to cause sensor 210 to scan in the particular configuration desired. Scan source 218 also provides the segment count signal to counter decoder 220 as well as a reset signal. The output of counter decoder 220 provides scan derived timing input signals to logic matrix 216.

Figure 11:
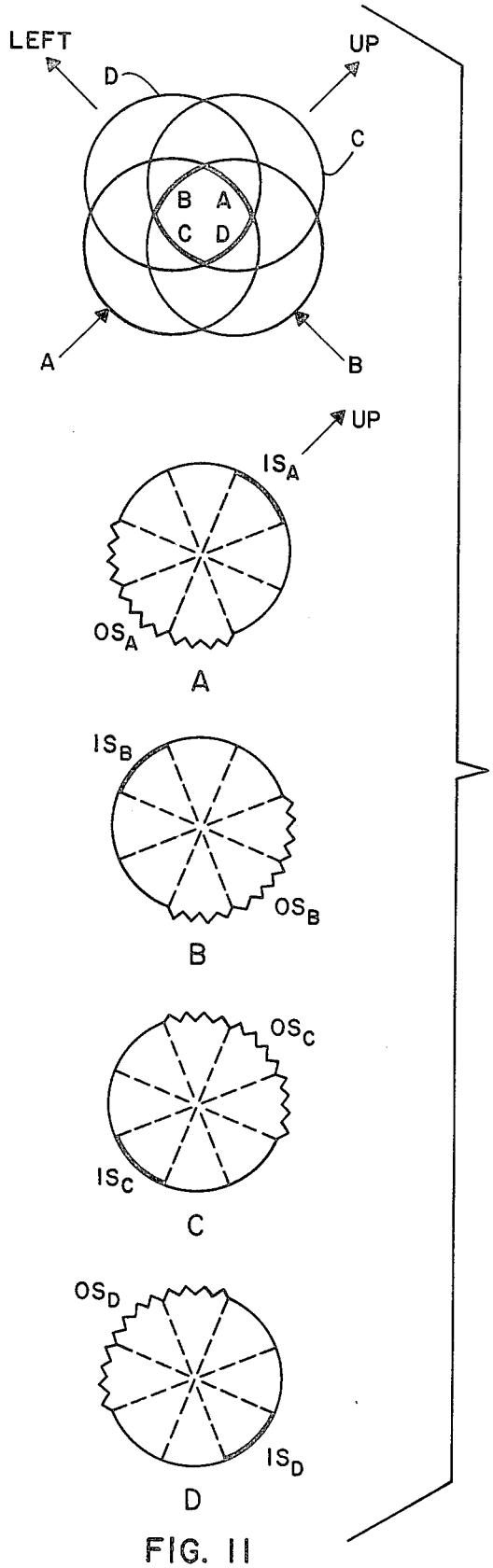
FIG. 11 is a diagram of scans showing how the inner areas and outer areas are formed in the preferred embodiment of FIG. 10.

Referring to FIG. 11 there is shown in diagram form a four circular scan. An inner area is generated where all four scans overlap and an outer area where there is no overlap. The inner area scan is shown in heavy line and the outer scan segment is shown with a wavey line. The video signals from each detector are associated with their respective scan, i.e., A, B, C, or D, and with specific scan segments, i.e., in FIG. 12. A video output signal at A, FIG. 10, corresponds to the presence of an object in segment $IS_A$ or $OS_A$ depending on what time during the scan the signal occured. This is accounted for in the logic derived from selected rules of the tracking system. One possible set of tracking rules is as follows:

| RULE NO. | RULE | TABLE ENTRY OR ENTRIES |
|---|---|---|
| 1. | If all inner segments cross object, no error | 1 |
| 2. | If one inner segment does not cross object, error is away from segment. | 2–5 |
| 3. | If two inner segments do not cross object, errors are away from segments. | 6–9 |
| 4. | If three inner segments do not cross object, error is away from single segment, cannot determine error in direction of paired segments. Wait until object appears in outer segment. | 10–12 |
| 5. | If any inner segment crosses object, ignore outer segment information in that same direction. | |
| 6. | If an inner segment pair does not cross object use outer segment information in same direction according to rules 2, 3. | 14–15 |

Table I is compiled based upon the above Rules showing the error signals which need to be generated as a function of the object designation signals.

TABLE I

| TABLE ENTRY NO. | VIDEO SIGNALS PRESENT DURING SEGMENT SIGNALS | | | | | | | | ERROR SIGNALS (Zeros are assumed where symbols are missing) | | | |
|---|---|---|---|---|---|---|---|---|---|---|---|---|
| | $IS_c$ | $IS_A$ | $IS_D$ | $IS_B$ | $OS_A$ | $OS_C$ | $OS_B$ | $OS_D$ | UP | DOWN | LEFT | RIGHT |
| 1 | 1 | 1 | 1 | 1 | ← any combination → | | | | 0 | 0 | 0 | 0 |
| 2 | 1 | 1 | 1 | 0 | | | | | | | | 1 |
| 3 | 1 | 1 | 0 | 1 | | | | | | | 1 | |
| 4 | 1 | 0 | 1 | 1 | | | | | | 1 | | |
| 5 | 0 | 1 | 1 | 1 | ↗ any combination ↙ | | | | 1 | | | |
| 6 | 1 | 0 | 0 | 1 | | | | | | 1 | 1 | |
| 7 | 0 | 1 | 1 | 0 | | | | | 1 | | | 1 |
| 8 | 1 | 0 | 1 | 0 | | | | | | 1 | | 1 |
| 9 | 0 | 1 | 0 | 1 | ↗ any combination ↙ | | | | 1 | | 1 | |
| 10 | 1 | 0 | 0 | 0 | | | | | | 1 | | |
| 11 | 0 | 1 | 0 | 0 | | | | | 1 | | | |
| 12 | 0 | 0 | 1 | 0 | | | | | | | | 1 |
| 13 | 0 | 0 | 0 | 1 | ↗ any combination ↙ | | | | | | 1 | |

TABLE I-continued

| TABLE ENTRY NO. | VIDEO SIGNALS PRESENT DURING: SEGMENT SIGNALS $IS_c$ | $IS_A$ | $IS_D$ | $IS_B$ | $OS_A$ | $OS_C$ | $OS_B$ | $OS_D$ | ERROR SIGNALS (Zeros are assumed where symbols are missing): UP | DOWN | LEFT | RIGHT |
|---|---|---|---|---|---|---|---|---|---|---|---|---|
| 14 | 1 | 1 | 0 | 0 | any comb. | | 1 | 0 | | | | 1 |
| | 0 | 1 | 0 | 0 | | | 0 | 1 | 1 | 1 | 1 | |
| | 1 | 0 | 0 | 0 | | | 1 | 1 | | | | |
| 15 | 0 | 0 | 1 | 1 | 1 | 0 | any comb. | | | 1 | | |
| | 0 | 0 | 0 | 1 | 0 | 1 | | | 1 | | 1 | |
| | 0 | 0 | 1 | 0 | 1 | 1 | | | | | | 1 |

Figure 12:
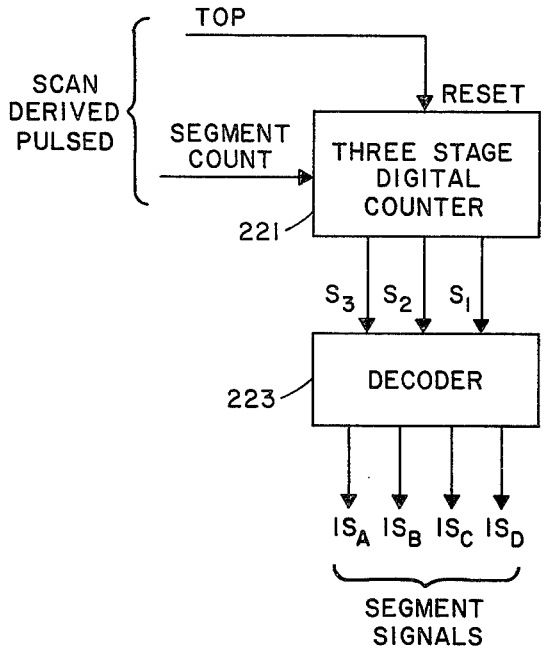
FIG. 12 is a block diagram showing how the signals are derived from the circular scans of FIG. 11.

FIG. 12 shows a three stage digital counter 221 (which may be three stage flip-flop circuit) which divides the circles into eight segments. The output from counter 221 is fed into a decoder 223 which will provide outputs to satisfy the following equations.

| Inner Area | Outer Area |
|---|---|
| $IS_A = S_1' S_2' S_3$ | $OS_A = S_1 S_3' + S_1 S_2'$ |
| $IS_B = S_1 S_2 S_3$ | $OS_B = S_1' S_2 + S_1 S_2' S_3''$ |
| $IS_C = S_1 S_2' S_3$ | $OS_C = S_1' S_2' + S_1' S_3'$ |
| $IS_D = S_1' S_2 S_3$ | $OS_D = S_1 S_2 + S_1' S_2' S_3'$ |

where letter with prime=0; letter without prime=1.

The implementation of the logic matrix 216 shown at FIG. 10 can be derived using traditional combinatorial system design which is well known in the art, i.e., Caldwell, Samual M., Switching Circuits and Logic Design, Wiley, New York, 1958, 119 through 143. The result is a combinatorial network which provides the proper error signals responding to any set of inputs.

Obviously many modifications and variations of the present invention are possible in the light of the above teachings. It is therefore to be understood that within the scope of the appended claims the invention may be practiced otherwise than as specifically described.

Figure 2:
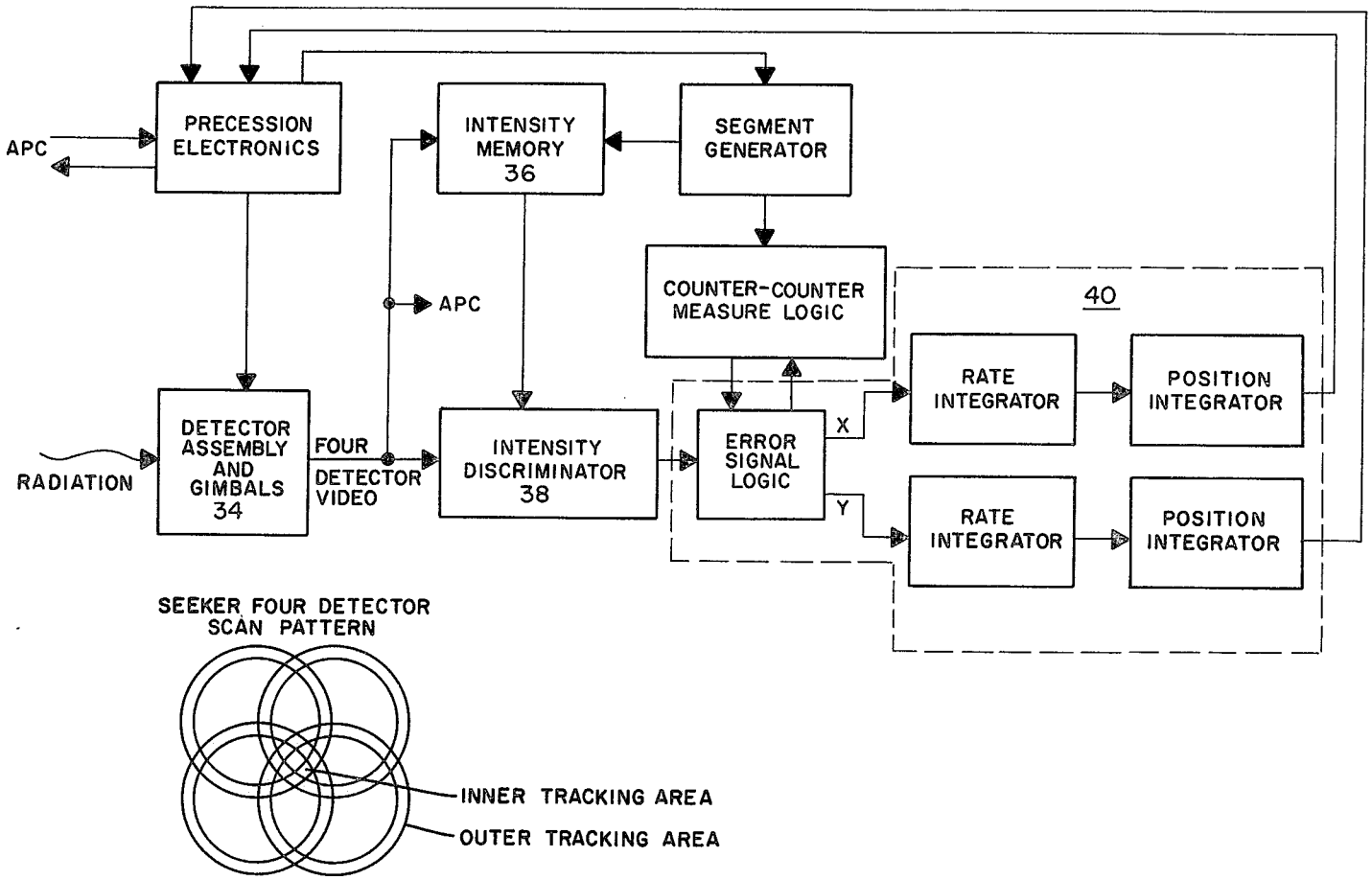
FIG. 2 is a block diagram showing a multiple detector tracker and seeker scan pattern which may be used in the present invention.
Figure 3:
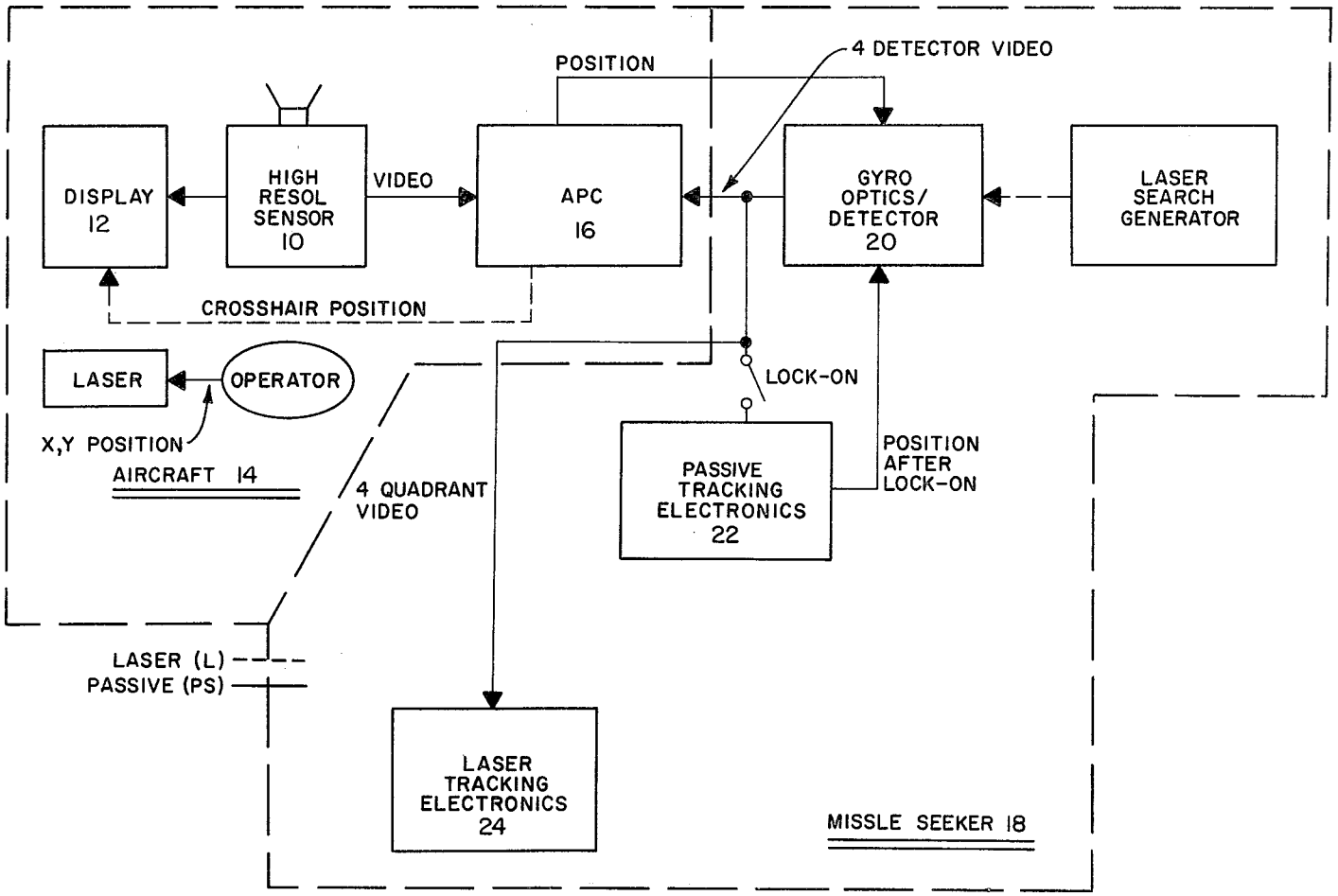
FIG. 3 is a block diagram showing the preferred embodiment of the present invention.

The seeker 18 shown in FIG. 3, consists of gyro-stablized optics 20 with a large collecting aperture and gimbal angle. The detector 26 as shown in FIG. 1, is a four-quadrant silicon detector 28 with four passive detectors imbedded therein. A filter having a 0.1 μm bandwidth at a wavelength of 1.06 μm is placed in front of the FIG. 1 detector. The filter has four holes which pass the passive radiation; and, at the same time, the filter acts as an aperture plate to define the resolution for aim-point correlation (APC) and passive tracking. The scanning necessary for the passive mode and for the APC is accomplished by off-setting the optical axis of the gyro-stabilized optics from their center of rotation. Thereby, the four silicon detectors 30 as defined by the holes in the filter scan in the circular patterns shown in FIG. 2.

Operation of the passive tracking system is shown in FIG. 2 and described in the above-identified patent application entitled BI-ADAPTIVE SCAN DIGITAL UNIVERSAL SENSOR TARGET TRACKER. A block diagram of the overall system of the present invention, including the passive and laser tracking systems, is shown in FIG. 3.

Although the passive is discussed above it will be summarized to facilitate disclosure of the present invention.

In the tracker of FIG. 2 the detectors in assembly 34 sense incoming radiation and provide outputs in response thereto, which outputs are coupled to automatic intensity circuit 36 and through an intensity discriminator or threshold 38 to an error signal generator 40. The detectors outputs are compared in the APC with the sensors output; and tracking error signals are generated in response thereto. The signals change the sight line of the seeker to cause the four detector scan pattern to become centered on the target. When the target is within the inner tracking area or, in the case of a large target, within the outer tracking area, the tracker may be locked-on to the target by the pilot.

The operation of the present invention shown in FIG. 3 is as follows: In the passive mode the pilot first acquires the target on the display 12; and, then he aligns the cross-hairs with the target. The aim-point correlator (APC) 16 correlates the sensor's (10) output, or video information, with the output of the non-imaging seeker 18. Maximum correlation occurs when the seeker detector (26) video signals completely match the sensor's (10) video signal. From that correlation the appropriate sight line shift for the seeker 18 is applied to the gyro-optics 20 such that sensor and seeker are aligned. Thereafter, the pilot may initiate tracking with the four silicon-detectors 30 which are part of the four quadrant detector 28.

In the laser mode the seeker 18, using the four quadrant detector 28, automatically performs a search for, and acquisition of, the laser illuminated target. The target area is simultaneously scanned by the four silicon-detectors 30. The resulting information from the four silicon-detectors is then correlated with the imaging video provided by the sensor 10. The point of maximum correlation between seeker and sensor indicates that the sensor 10 and the seeker 18 are seeing the same scene. The match appears on the display in the window of the crosshairs, from which the pilot can identify and locate the laser illuminated target with accuracy.

The laser mode can be used with either airborne illumination, surface originating illumination, or both. That is, the laser source can be positioned in the aircraft or other aircraft, on the earth's surface and controlled by, such as, an infantryman soldier, or by both, though not simultaneously. If the source is airborne the pilot can slew the laser to illuminate the desired target since he obtains a positive indication of the point he is tracking. The laser tracker would then track the illuminated point on the ground with the four quadrant detector. Through aim-point correlation between the four silicon detectors and the sensor the pilot can determine the position of the laser illuminated point on the ground by watching his display. The pilot can then slew the laser such that the desired target becomes illuminated.

The advantages of the present invention are that the system uses the same detector for both the passive and laser modes; that passive target detection and identification is accomplished in the aircraft and passive target tracking is performed with a minimum number of resolution elements; that laser tracking is performed in the seeker and the pilot is provided with a visual display of the targets location, independent of seeker and aircraft datum line misalignment; and, that the visual display can be used to slew an on-board laser to any desired target within the sensors field of view. Although the previous paragraphs describe a specific application of using a silicon vidicon and silicon detectors, the teaching can be used in other areas of the spectrum. As an example, target acquisition can be performed with a forward looking infrared search set wherein the seeker would have a four quadrant cadmium tellurite detector integrated with four individual detectors of the same material. In that example, the four quadrant detector would track the energy of a 10.6 $\mu$m pulsed laser while the four individual detectors would be used for passive target tracking and aim-point correlation.

What is claimed is:

1. A dual mode guidance system having a first, passive mode and a second, active mode in which a missile seeker is aligned with a sensor in response to the output of the sensor in the first mode, and the seeker acquires a laser illuminated object and the outputs of the seeker and the sensor are compared to determine whether or not the object illuminated is the object of interest in the second mode, wherein the modes are mutually exclusive and selectable by the operator, comprising:

sensing means for electronically scanning the field of view of said system and providing a video signal output thereof;

a source of laser light for selectively illuminating an object of interest within said field;

seeking means for electronically scanning at least a portion of said field of view independently of said sensing means and providing a video signal output thereof;

first means coupled to said seeking means for aligning the scan of said seeking means with the illumination reflected by said laser illuminated object in the second of said dual modes;

correlating means coupled to the video signal outputs of said seeking means and said sensing means for comparing said signals and providing an error signal to said seeking means in said first mode for adjusting the scan of said seeking means such that its scan is aligned with a pre-selected portion of the scan of said sensing means, and providing an output in said second mode indicative of the scene scanned by said seeking means; and displaying means coupled to said sensing means and said correlating means for visually displaying the field of view scanned by said sensing means in said first mode, and visually displaying a graphic representation of the portion scanned by said seeking means in covering relationship to said field of view display in said second mode.

2. The system of claim 1 further comprising switching means coupled to said seeking means for selecting said first mode or said second mode.

3. The system of claim 2 wherein said seeking means includes a four quadrant detector having four detectors and a circular scan pattern for detecting radiation.

4. The system of claim 3 wherein said seeking means further includes a rotating filter having four holes in covering relationship to said detectors.

5. The system of claim 4 wherein said sensing means is a silicon vidicon.

* * * * *